US005662297A

United States Patent [19]

Christensen et al.

[11] Patent Number: 5,662,297

[45] Date of Patent: Sep. 2, 1997

[54] ADJUSTABLE SHOWER CURTAIN ROD

[76] Inventors: James Richard Christensen, 2700 63 St., Sacramento, Calif. 95817; Kenneth Tarlow, 94 Birch Ave., Corte Madera, Calif. 94925

[21] Appl. No.: 537,354

[22] Filed: Oct. 3, 1995

[51] Int. Cl.[6] ..... A47K 3/00; A47K 3/08

[52] U.S. Cl. ..... 211/105.1; 248/200.1; 248/644; 211/123; 211/182; 4/558; 4/608; 4/610

[58] Field of Search ..... 248/200.1, 644; 211/105.1, 105.2, 105.3, 105.4, 123, 182; 4/558, 608, 610

[56] References Cited

U.S. PATENT DOCUMENTS

| | | | |
|---|---|---|---|
| 2,774,974 | 12/1956 | Zaloga | 4/154 |
| 2,778,030 | 1/1957 | Goche | 211/105.2 |
| 3,418,665 | 12/1968 | Long | 4/610 |
| 3,872,520 | 3/1975 | Tyconik | 4/154 |
| 3,999,727 | 12/1976 | Rennemann | 211/182 |
| 4,117,557 | 10/1978 | McPeak | 160/330 |
| 4,158,896 | 6/1979 | Farkas | 248/200.1 |
| 4,754,504 | 7/1988 | Cellini | 160/330 |
| 5,007,120 | 4/1991 | Annand | 4/558 |
| 5,031,257 | 7/1991 | Jeffery | 160/330 |
| 5,345,624 | 9/1994 | Brown, III | 4/610 |

*Primary Examiner*—Alvin C. Chin-Shue
*Assistant Examiner*—Long D. Phan

[57] ABSTRACT

A shower curtain support rod assembly which mounts between opposing bathtub stall walls which, when installed, allows a shower curtain to be slidably movable in an inward and outward direction with respect to the longitudinal edge of the bathtub, thereby creating more space for a shower taker. When a shower is not in progress, the shower curtain can be slid inward thereby creating more space in the remaining bathroom area.

4 Claims, 4 Drawing Sheets

ADJUSTABLE SHOWER CURTAIN ROD

BACKGROUND OF THE INVENTION

1. Field of the Invention

The present invention relates to an adjustable curtain rod support, and more specifically to an adjustable shower curtain rod support for positionally controlling a shower curtain so as to prevent inward movement of the shower curtain toward the bather and to create more room for the bather when taking a shower.

2. Description of the Related Art

The tendency of a shower curtain, when in use, to move inward toward the bather is well known. This inward movement of a shower curtain is due, at least in part, to the draft of convection air current created by the very warm air on the inner side of the shower curtain, said warm air being heated by the warm water spraying from a shower head, and the relatively cooler air present on the outer side of the shower curtain.

Several attempts have been made to prevent the aforesaid inward movement of a shower curtain by retrofitting the curtain rod with a curtain support and the like. U.S. Pat. Nos. 3,872,520 (Tyconik, 1975), 2,774,974 (Zaloga, 1955), 5,007,120 (Annand, 1991) and 5,345,624 (Brown) all propose designs which involve attaching additional support members to the existing curtain rod. The drawbacks to all the above designs are that all the above designs create unsightly bulges in the shower curtain and create obstacles making it difficult for the bather to enter and exit the shower.

OBJECTS AND ADVANTAGES OF THE INVENTION

The main object of the present invention is to eliminate the previously described disadvantages and provide an adjustable shower curtain rod for positionally controlling a shower curtain so as to prevent the inward movement of the curtain toward the bather.

A further object of the present invention is to provide more internal shower space when a shower is being taken and then to be able to reduce the space when the shower is not in use thereby regaining valuable bathroom space.

A further object of the invention is to provide an adjustable shower curtain rod which is supported by a pair of secondary rods and is slidably movable in an inward and outward direction with relation to the secondary support rods.

A further object of the present invention is to provide an adjustable shower curtain rod which can be easily locked in place.

A further object of the present invention is to provide an adjustable shower curtain rod which is economical to make and reasonably compact for shipping and packaging purposes.

These and further objects, advantages and features of the invention will become apparent from the following description thereof taken in conjunction with he accompanying drawings which illustrate specific embodiments of the invention.

DETAILED DESCRIPTION OF THE PREFERRED EMBODIMENT

Figure 1:
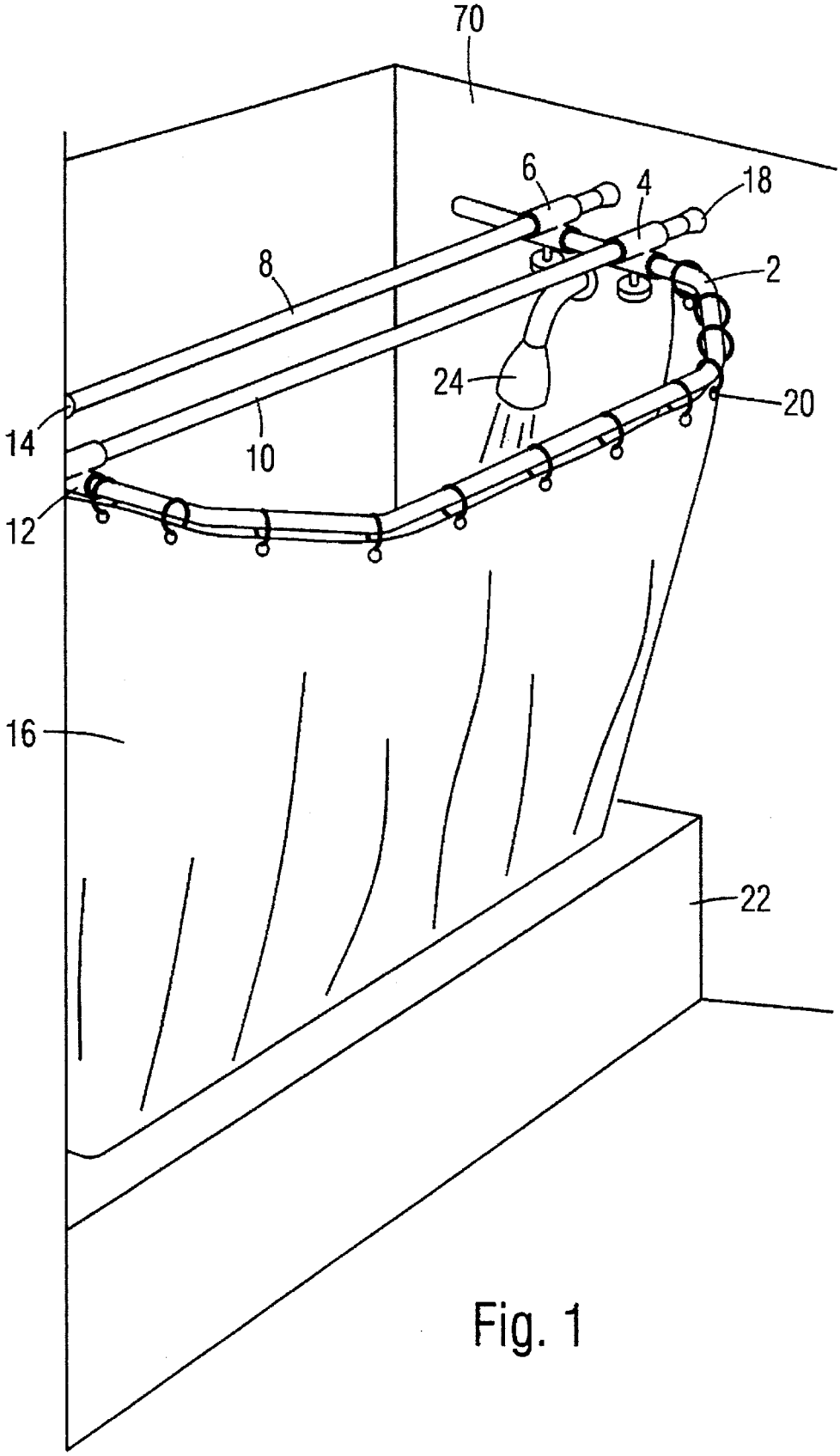
FIG. 1 is a perspective view of the present invention.
Figure 2:
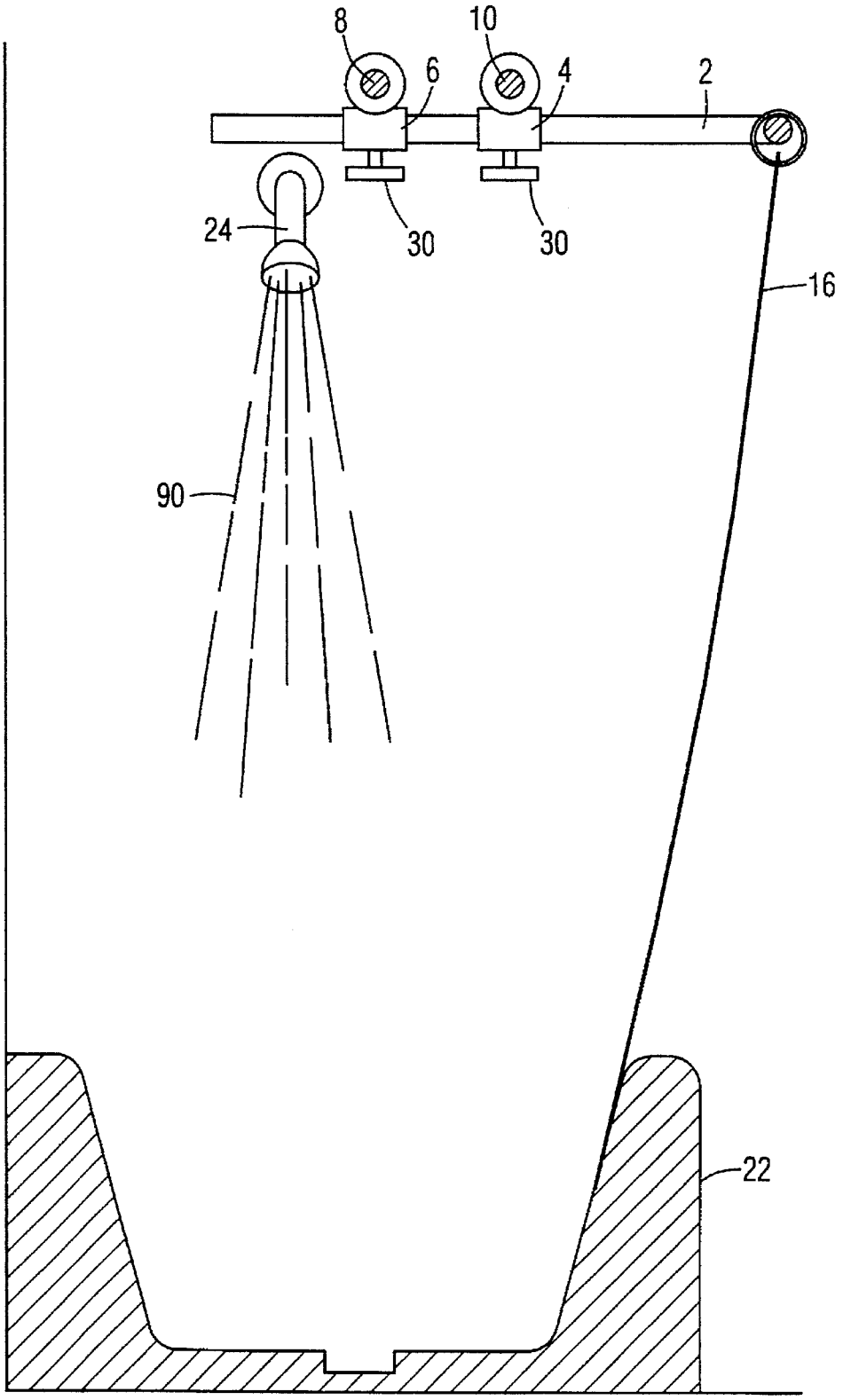
FIG. 2 is a section view showing the adjustable shower curtain rod of the present invention in an extended outward position.
Figure 3:
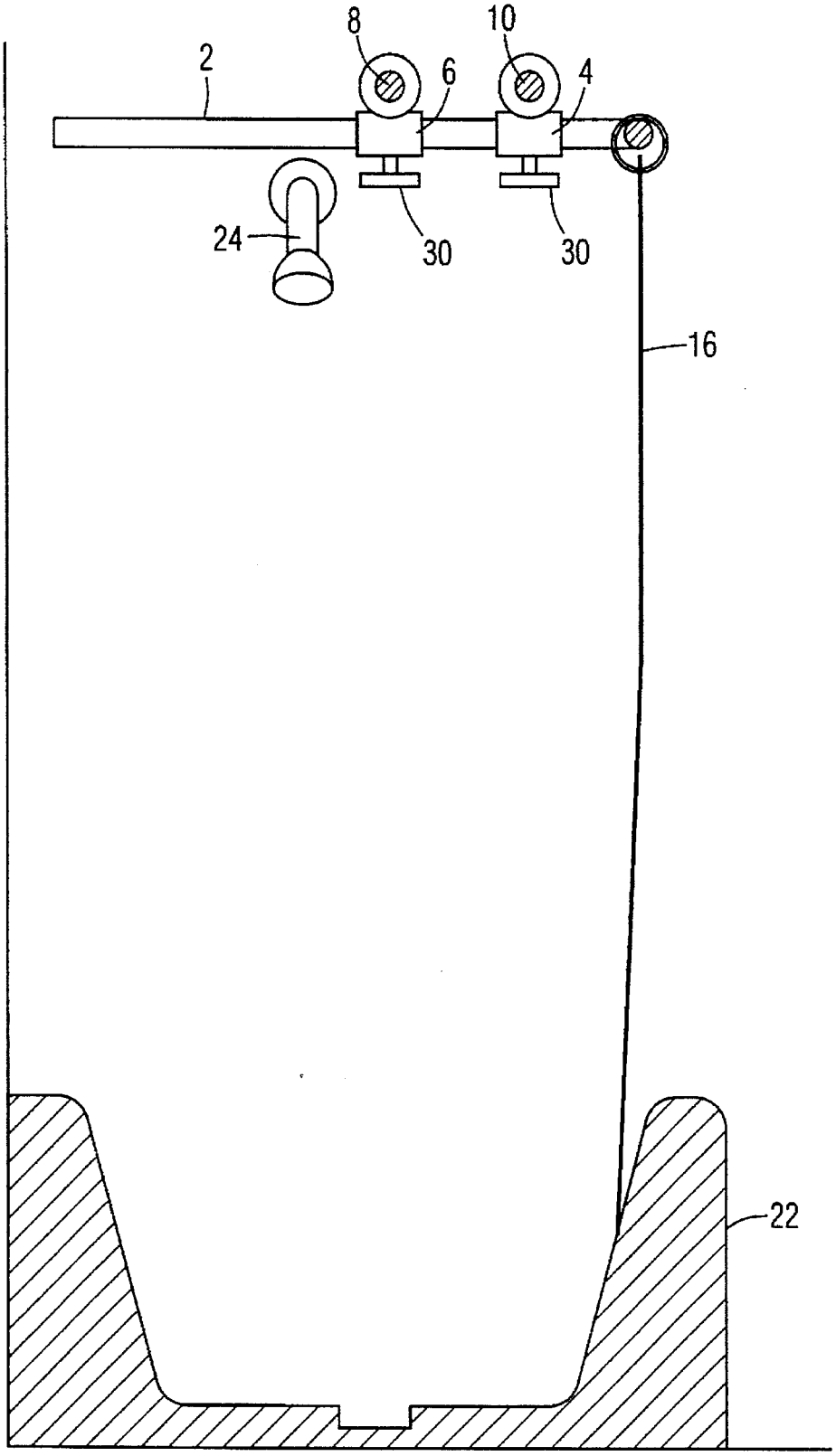
FIG. 3 is a section view showing the adjustable shower curtain rod of the present invention in a retracted inward position.
Figure 4:
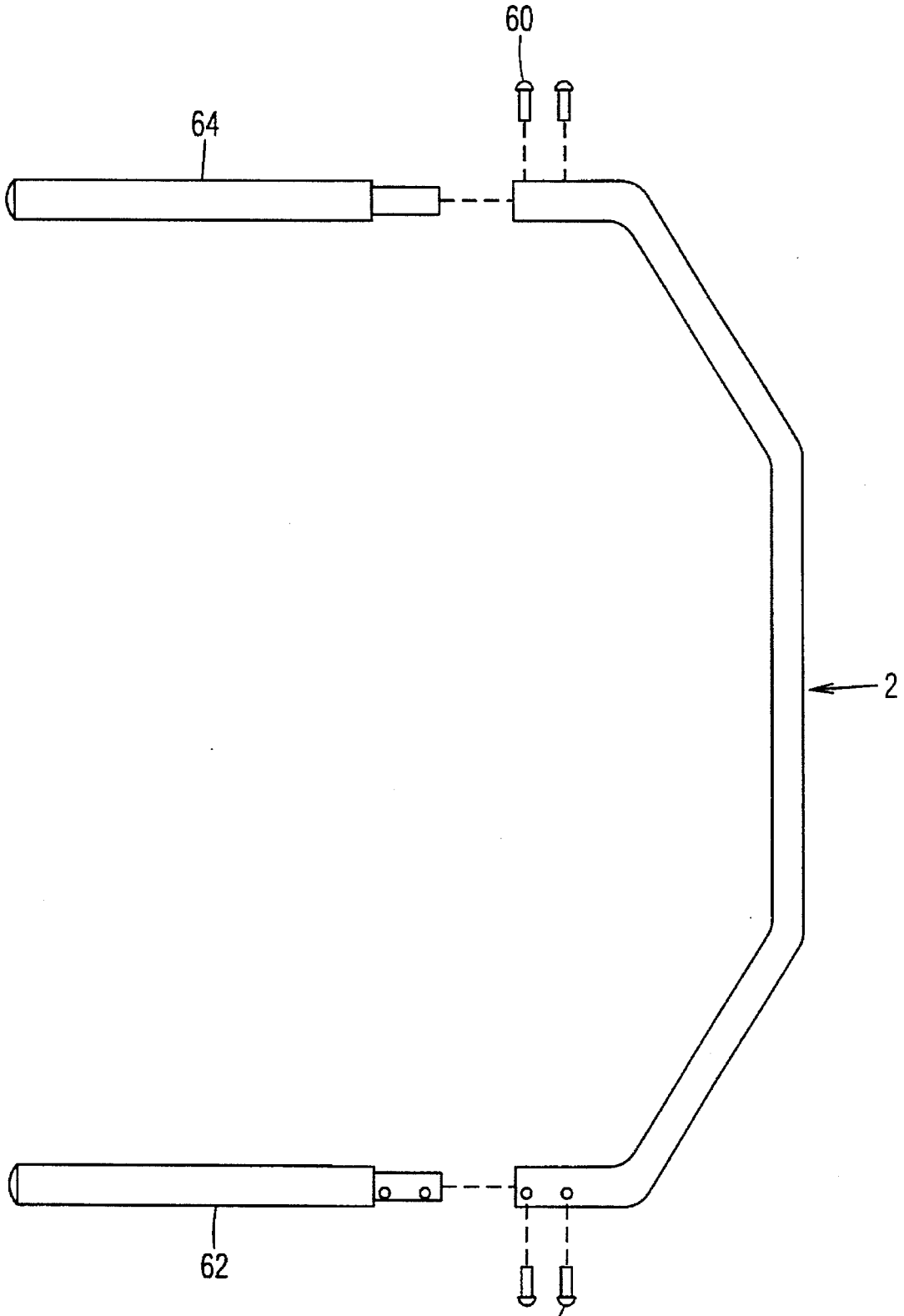
FIG. 4 is a top view of the present invention showing how the extension rod is comprised of three pieces which disassemble for compact shipping and packaging.

Referring now to FIG. 1 two secondary support rods 8,10 are suspended above the shower head 24 and held by positive pressure when tip 18 is screwed outwardly forcing positive engagement with shower wall 70. Most existing shower curtain rods attach in this way. Cross tubular support brackets 4,6,12,14 are permanently attached to secondary support rods 8,10 at either end of said rods. Cross tubular support brackets 4,6,12,14 have a lower tube holding member which is perpendicular to the integral upper tube holding portion. Main U-shaped shower curtain rod 2 is bowed outward at its middle portion and has perpendicularly oriented tubular arms at each end of said main rod 2. These arms extend through the Cross tubular support brackets 4,6,12,14 and may be adjusted in an inward or outward position thereby causing the attached shower curtain 20 to extend inward or outward with relation to the bathtub wall 22. FIG. 2 shows a section view where the main shower curtain rod 2 is in an outwardly extended position allowing a person additional room for taking a shower and preventing the shower curtain 16 from being sucked inward from warm air currents caused by warm water 90 emanating from shower head 24. Lock Knobs 30 allow the main shower support rod 2 to be rigidly secured. FIG. 3 shows a section view where the main shower curtain rod 2 is retracted into a storage position so that shower curtain 16 does not extent out thereby regaining square footage which is usually at a premium in most bathrooms. FIG. 4 shows a disassembled view of main curtain rod 2 where legs 64,62 are removed by loosening bolts 60 thereby allowing the main curtain rod assembly 2 to be packed and shipped in a minimum of space.

Although the preceding description contains many specificity's, these should not be construed as limiting the scope of the invention but merely providing illustrations of some of the presently preferred embodiments of this invention.

What is claimed is:

1. An adjustable shower curtain supporting apparatus for a rectangular shower stall having a main wall connecting opposite end walls, comprising:

a pair of parallel support rods adapted to extend between said opposite end walls of said shower stall, said support rods having extendable tips adapted to apply outward pressure against said opposite end walls so as to be supported thereon by friction;

a pair of brackets attached at opposite ends of each of said support rods, each of said brackets including a tube holding member; and a U-shaped shower curtain rod having a pair of parallel arms connected by a middle portion, said arms being orthogonal to said support rods, each of said arms being slidably positioned in said tube holding members at adjacent ends of said support rods, a free end of each of said arms being adapted to be positioned away from said main wall of said shower stall, said middle portion of said shower curtain rod being adapted to support a shower curtain, said shower curtain rod being stably supported in a generally horizontal plane by said pair of parallel support rods, said shower curtain rod being adapted to be movable toward said main wall for conserving space outside said shower stall when said shower stall is vacant, said shower curtain rod being adapted to be movable away from said main wall for expanding space within said shower stall when said shower stall is in use.

2. The adjustable shower curtain supporting apparatus of claim 1, wherein said middle portion of said U-shaped shower curtain rod is bowed outwardly away from said support rods for increasing space within said shower stall.

3. The adjustable shower curtain supporting apparatus of claim 1, wherein each of said arms of said shower curtain rod is removably attached to said middle portion, so that said shower curtain rod can be disassembled for compact shipping.

4. The adjustable shower curtain supporting apparatus of claim 1, further including a lock knob attached to each of said tube holding members for locking said arms in a desired position.

* * * * *